US006688431B2

(12) United States Patent
Oh

(10) Patent No.: US 6,688,431 B2
(45) **Date of Patent: *Feb. 10, 2004**

(54) LUBRICANT SUPPLYING APPARATUS OF RECIPROCATING COMPRESSOR

(75) Inventor: Won-Sik Oh, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/958,981

(22) PCT Filed: Feb. 17, 2001

(86) PCT No.: PCT/KR01/00240

§ 371 (c)(1),
(2), (4) Date: Oct. 16, 2001

(87) PCT Pub. No.: WO01/61191

PCT Pub. Date: Aug. 23, 2001

(65) Prior Publication Data

US 2002/0157902 A1 Oct. 31, 2002

(30) Foreign Application Priority Data

Feb. 17, 2000 (KR) ..... 2000/7575

(51) Int. Cl.[7] ..... F01M 1/00
(52) U.S. Cl. ..... 184/6.16; 417/571; 417/562
(58) Field of Search ..... 184/6.16; 417/571, 417/557, 562, 417; 415/88

(56) References Cited

U.S. PATENT DOCUMENTS 5,993,175 A * 11/1999 Kim et al. ..... 417/417
6,089,352 A * 7/2000 Kim et al. ..... 184/6.16
6,220,393 B1 * 4/2001 Oh et al. ..... 184/6.16
6,299,421 B1 * 10/2001 Oh et al. ..... 417/571
6,409,484 B1 * 6/2002 Hyun ..... 417/417
6,494,293 B1 * 12/2002 Jung ..... 184/6.16

FOREIGN PATENT DOCUMENTS

| | | |
|---|---|---|
| JP | A12-2181 | 1/2000 |
| JP | A12-161211 | 6/2000 |
| KR | A97-75358 | 12/1997 |
| KR | A98-2855 | 3/1998 |

* cited by examiner

*Primary Examiner*—David Fenstermacher
(74) *Attorney, Agent, or Firm*—Birch, Stewart, Kolasch & Birch, LLP

(57) ABSTRACT

A lubricant supply apparatus for a reciprocating compressor is provided having a lubricant cylinder fixed to a compressing unit having a lubricant suction passage and oscillating with the compressing unit. A lubricant piston is slidably inserted into the lubricant cylinder for sucking and discharging lubricant by generating a pressure change inside the lubricant cylinder in coordinated oscillation with the compressing unit. A lubricant valve fixed to the compressing unit and having a lubricant suction valve opening in a suction process of the lubricant piston and a lubricant discharge valve opening in a discharge process of the lubricant piston are also provided. A valve cover covers the lubricant valve and is fixed to the compressing unit and includes a discharge port opening and shutting by the lubricant suction valve.

22 Claims, 9 Drawing Sheets

LUBRICANT SUPPLYING APPARATUS OF RECIPROCATING COMPRESSOR

This application is the national phase under 35 U.S.C. §371 of PCT International Application No. PCT/KR01/00240 which has an International filing date of Feb. 17, 2001, which designated the United States of America and was published in English.

TECHNICAL FIELD

The present invention relates to a lubricant supply apparatus for a reciprocating compressor, and in particular to a lubricant supply apparatus for a reciprocating compressor that is capable of reducing the number of parts and facilitating assembling.

BACKGROUND ART

In general, a reciprocating compressor compresses refrigerant gas by a linear reciprocating motion of a piston combined with a magnet and coil assembly in place of a crankshaft.

As depicted in FIG. 1, a reciprocating compressor in accordance with the prior art includes a compressing unit C horizontally installed inside a casing V containing lubricant at a lower portion. The compressing unit C draws in, compresses and discharges a refrigerant. A lubricant supply apparatus O is fixed to the exterior of the compressing unit C for supplying lubricant thereto.

As depicted in FIGS. 2A–2B, the lubricant supply apparatus O includes a lubricant cylinder 21 installed at the bottom surface of the compressing unit C. A lubricant piston 22 is inserted inside the lubricant cylinder 21 and divides the interior of the lubricant cylinder 21 into a suction area S1 and a discharge area S2. A first lubricant spring 23A and a second lubricant spring 23B elastically support both ends of the lubricant piston 22 at the end of the lubricant cylinder 22. A lubricant suction valve 24 is installed at an outlet end of the lubricant piston 22 and is supported by the second lubricant spring 23B. A lubricant discharge valve 25 is installed at an outlet side of the lubricant cylinder 21.

The lubricant piston 22 is inserted into and slidable with respect to the lubricant cylinder 21, e.g, an outer circumference of the lubricant piston 22 is in contact with the inner circumference of the lubricant cylinder 21. A lubricant passage 22*a* is formed inward of the lubricant cylinder 21 by penetrating the lubricant cylinder 21 from an inlet to an outlet.

The lubricant suction valve 24 is compressed and supported by the second lubricant spring 23B at a section of the outlet of the lubricant piston 22 so as to open and shut the lubricant passage 22*a* formed inward of the lubricant piston 22.

In FIGS. 1–2B, unexplained reference numeral 1 is a frame, 1*a* is a lubricant suction channel, 3 is a cylinder, 4 is an inner stator and an outer stator, 5 is a magnetic assembly, 6 is a piston, 7 is a suction valve, 8 is a discharge valve assembly, 9 is a suction pipe, 26 is a suction cover, 27 is a discharge cover, S1 is a suction area, and a S2 is a discharge area.

The operation of the lubricant supply apparatus of the reciprocating compressor in accordance with the prior art will be described hereinafter. In a linear reciprocating motion of the magnetic assembly 5 of a reciprocating motor, the compressing unit C oscillates horizontally along with the magnetic assembly 5, etc., the linear reciprocating movement is transmitted to the lubricant cylinder 21 fixed to the compressing unit C, e.g., the lubricant cylinder 21 also performs a linear reciprocating motion. The lubricant piston 22 is slidably inserted into the lubricant cylinder 21 and draws in and discharges lubricant by performing a reciprocating motion inside the lubricant cylinder 21 due to an inertia force opposed to the reciprocating motion of the lubricant cylinder 21.

First, as depicted in FIG. 2A, when the lubricant cylinder 21 moves to a "P" direction, the lubricant piston 22 moves in a direction opposite to a motion of the lubricant cylinder 21 by overcoming the first lubricant spring 23A. Since a pressure of the discharge area S2 is lower than a pressure of the suction area S1, lubricant of the suction area S1 flows to the discharge area S2 through the lubricant passage 22*a*. The lubricant suction valve 24 is opened and the lubricant discharge valve 25 returns and shuts the discharge side of the lubricant cylinder 21, e.g., thereby preventing a back flow of lubricant.

As depicted in FIG. 2B, when the lubricant cylinder 21 moves to a "Q" direction, the lubricant piston 22 moves in a direction opposite to a motion of the lubricant cylinder 21 by overcoming the second lubricant spring 23B. This action pushes lubricant filled inside the discharge area S2, and at the same time lubricant is filled in the suction area S1 by flowing through a gap between the lubricant cylinder 21 and a lubricant suction cover 26. The lubricant passage 22*a* of the lubricant piston 22 is shut by shutting the lubricant suction valve 24. In contrast, if the lubricant discharge valve 25 is opened, the discharge side of the lubricant cylinder 21 is opened.

However, the inventor of the present application has determined that the lubricant supply apparatus of the reciprocating compressor of the background art suffers from the following problems.

First, in the above-identified lubricant supply apparatus for a reciprocating compressor, a lubricant suction channel and a lubricant discharge channel are separately placed at both sides of a lubricant piston. In addition, lubricant is guided from a suction area to a discharge area through a lubricant passage formed inside the lubricant piston.

However, since the lubricant passage has to be formed inside the lubricant piston as small as possible, it is difficult to fabricate the lubricant passage. When a diameter of the lubricant passage increases in order to facilitate the fabrication of the lubricant passage, the required size of the lubricant piston increases. Accordingly a compact lubricant supply apparatus cannot be provided in the above-identified lubricant supply apparatus of the prior art.

In addition, since the size of a lubricant suction valve controlling suction and discharge of lubricant is small, manual assembly and operation is more difficult, and as a result, productivity is lowered. Since an opening and shutting portion (not shown) of the lubricant suction valve is bridged by the compression coil springs supporting the lubricant piston, suction and discharge of lubricant cannot be controlled appropriately. Further, smooth operation cannot be performed when impurities stick to the lubricant suction valve. Accordingly reliability of parts and operation is significantly lowered. In addition, since an increased number of parts are required in order to construct the lubricant supply apparatus, the complexity of the assembly process is increased, and productivity is decreased.

SUMMARY OF THE INVENTION

Accordingly, in order to solve above-mentioned problems, it is an object of the present invention to provide a lubricant supply apparatus of for a reciprocating compressor that is capable of supplying lubricant smoothly, without forming a lubricant passage in a lubricant piston, and while maintaining a compact structure.

In addition, it is another object of the present invention to provide a lubricant supply apparatus for a reciprocating compressor that is capable of supplying lubricant while also simplifying the assembly of the lubricant supply apparatus.

It is another object to prevent parts of the lubricant supply apparatus from interfering with other parts.

It is still another object of the present invention to provide a lubricant supply apparatus of a reciprocating compressor that is capable of improving productivity by simplifying assembly, e.g., by decreasing the number of parts.

These and other objects are accomplished by a reciprocating compressor comprising a reciprocating motor having a reciprocating magnetic assembly positioned between an inner stator and an outer stator;

a compression unit having a cylinder and a lubricant guide passage guiding lubricant inside the cylinder; and a piston operatively connected to the magnetic assembly for compressing a refrigerant while sliding inside the cylinder; and a lubricant supply apparatus for the reciprocating compressor, including a hollow lubricant cylinder having an interior space; a lubricant piston being slidably installed inside the lubricant cylinder; a lubricant suction channel connected to the interior space of the lubricant cylinder to draw in lubricant stored in a lubrication storage container of the reciprocating compressor; a lubricant discharge channel connected to the interior space of the lubricant cylinder to discharge lubricant; wherein the lubricant suction passage and the lubricant discharge passage are placed at a side of the lubricant cylinder centering around the lubricant piston.

These and other objects are accomplished by a reciprocating compressor comprising a reciprocating motor having a reciprocating magnetic assembly positioned between an inner stator and an outer stator; a compression unit having a cylinder and a lubricant guide passage guiding lubricant inside the cylinder; and a piston operatively connected to the magnetic assembly for compressing a refrigerant while sliding inside the cylinder; and a lubricant supply apparatus for the reciprocating compressor, including a hollow lubricant cylinder having an interior space; a lubricant piston placed inside the lubricant cylinder and being capable of sliding within the cylinder; a lubricant suction channel connected to the interior space of the lubricant cylinder to draw in lubricant stored in a lubricant storage container of the reciprocating compressor; a lubricant discharge channel connected to the interior space of the lubricant cylinder to discharge lubricant; a lubricant valve unit having a lubricant suction valve and a discharge valve, a lubricant suction passage and a lubricant discharge passage and a valve cover; wherein the lubricant suction passage and the lubricant discharge passage are placed at a side of the lubricant cylinder centering around the lubricant piston, and the lubricant valve unit is placed at the exterior of the lubricant cylinder.

These and other objects are accomplished by a reciprocating compressor comprising a reciprocating motor having a reciprocating magnetic assembly positioned between an inner stator and an outer stator; a compression unit having a cylinder and a lubricant guide passage guiding lubricant inside the cylinder; and a piston operatively connected to the magnetic assembly for compressing a refrigerant while sliding inside the cylinder; and a lubricant supply apparatus for the reciprocating compressor, including a hollow lubricant cylinder having an interior space; a lubricant piston placed inside the lubricant cylinder and being capable of sliding within the lubricant cylinder; a lubricant suction channel connected to the interior space of the lubricant cylinder to draw in lubricant stored in a lubricant storage container; a lubricant discharge channel connected to the interior space of the lubricant cylinder so as to discharge lubricant; a lubricant valve unit having a lubricant suction valve and a discharge valve, a lubricant suction passage and a lubricant discharge passage and a valve cover; wherein the lubricant valve unit is placed on the exterior of the lubricant cylinder.

DETAILED DESCRIPTION OF THE INVENTION

Figure 1:
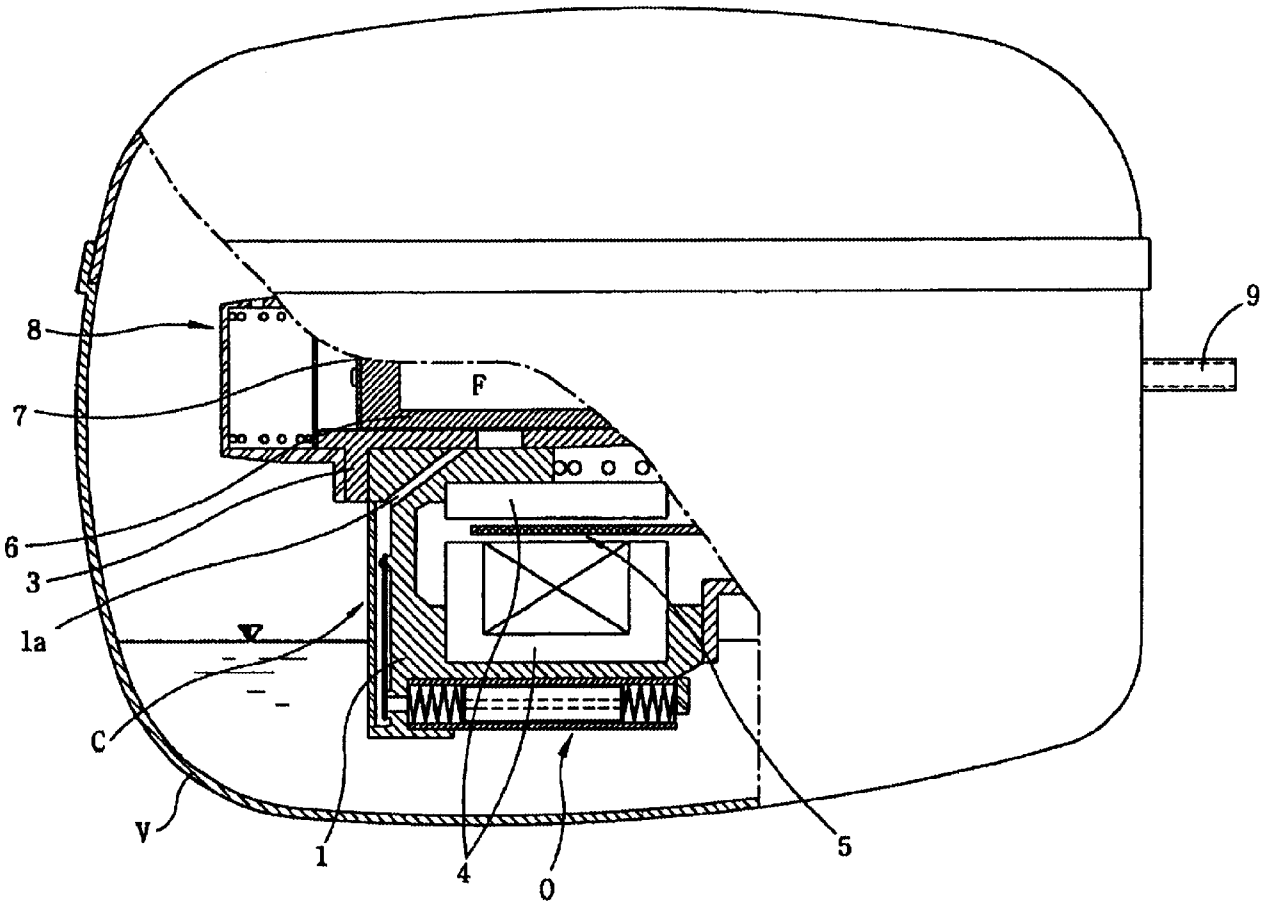
FIG. 1 PRIOR ART
FIG. 1 is a longitudinal sectional view illustrating a reciprocating compressor in accordance with the prior art.
Figure 2A:
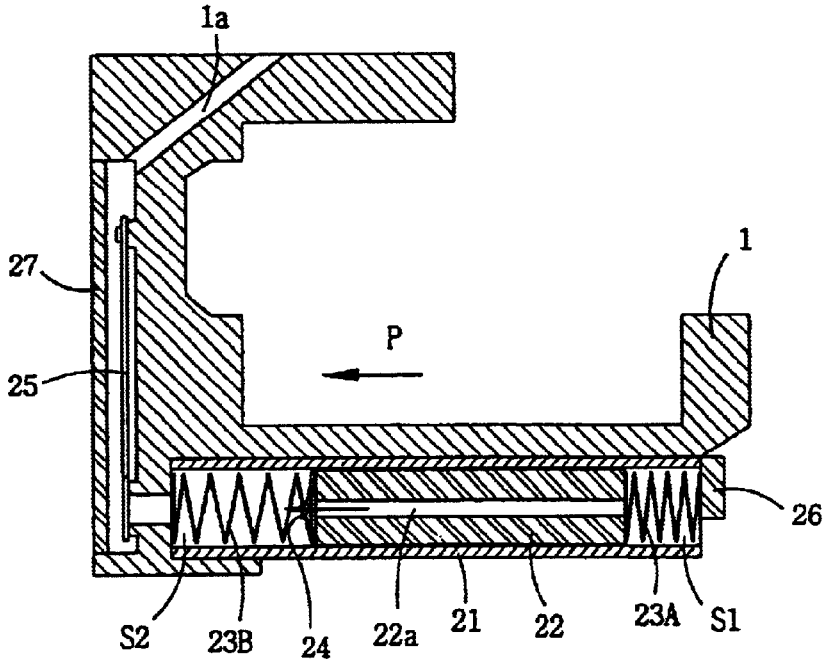
FIG.2A PRIOR ART
FIG. 2A is a longitudinal sectional view illustrating the operation of the lubricant supply apparatus of the reciprocating compressor in accordance with the prior art.
Figure 2B:
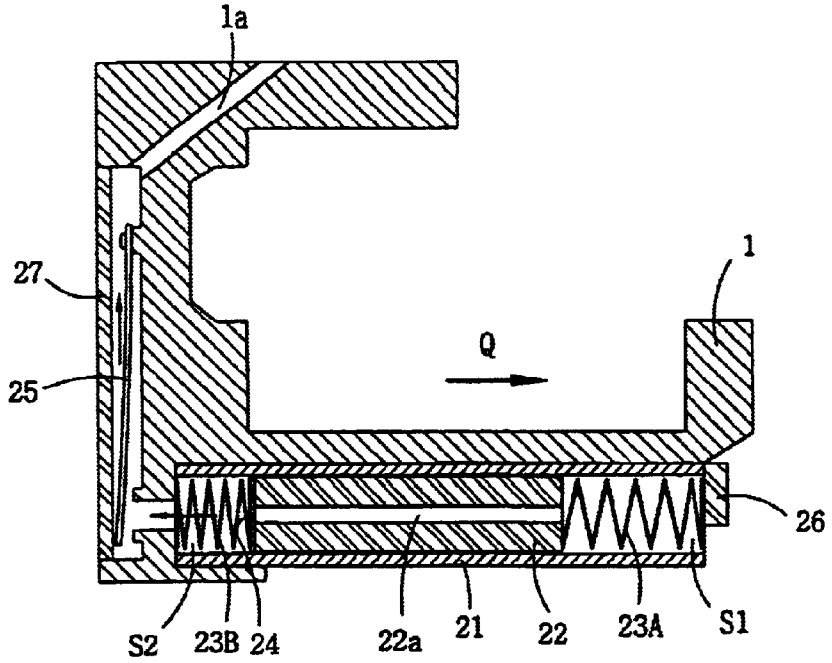
FIG.2B PRIOR ART
FIG. 2B is a longitudinal sectional view illustrating the operation of the lubricant supply apparatus of the reciprocating compressor in accordance with the prior art.

Hereinafter, a lubricant supply apparatus for a reciprocating compressor in accordance with the present invention will now be described in greater detail hereinafter with reference to the accompanying drawings.

In describing reference numerals, parts that are the same as those parts described hereinabove with reference to FIGS.

1–2B will have the same reference numerals, and duplicate descriptions will be omitted hereinafter.

Figure 3:
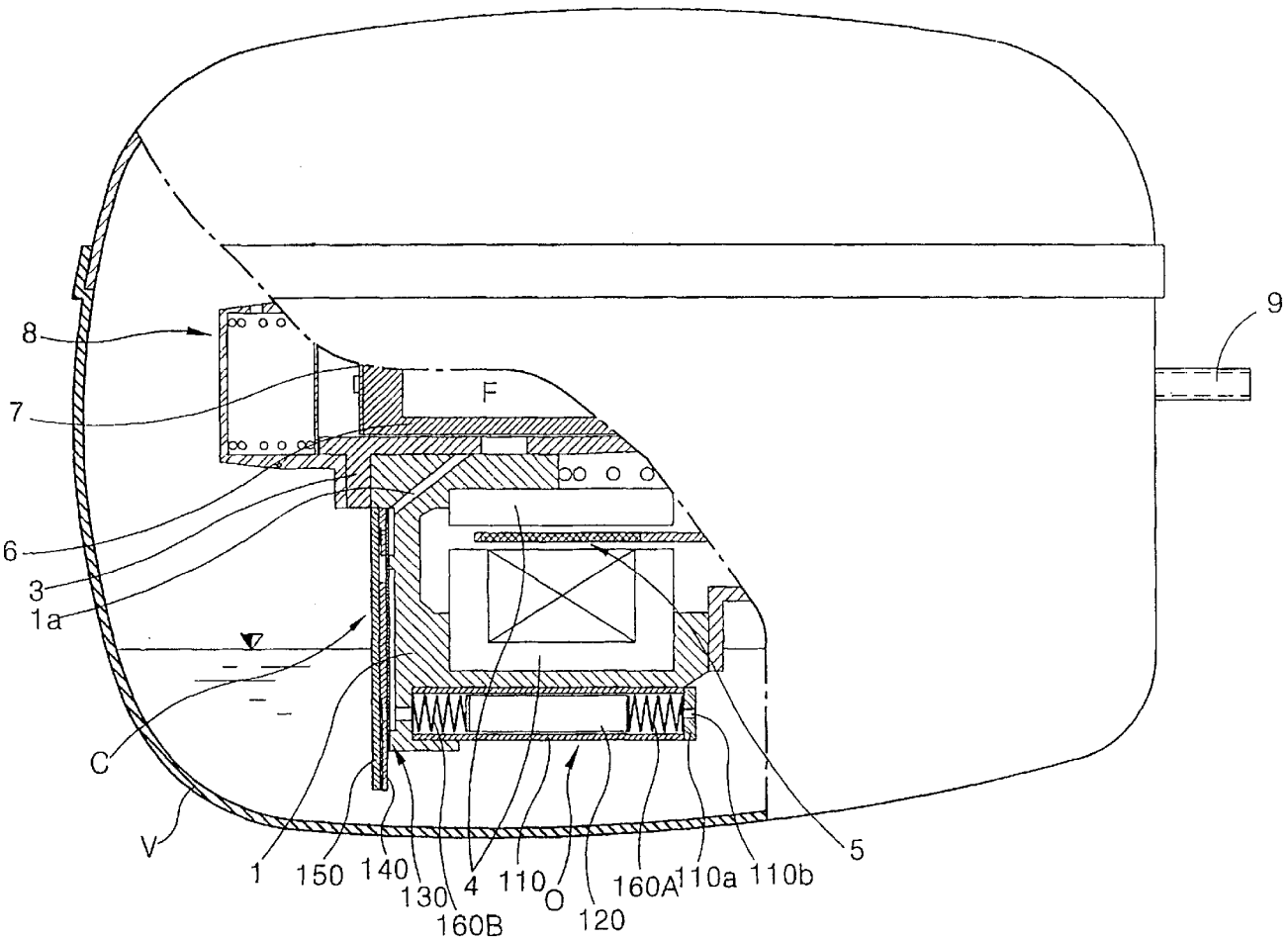
FIG. 3 is a longitudinal sectional view illustrating embodiment of a reciprocating compressor including a lubricant supply apparatus in accordance with the present invention.
Figure 4:
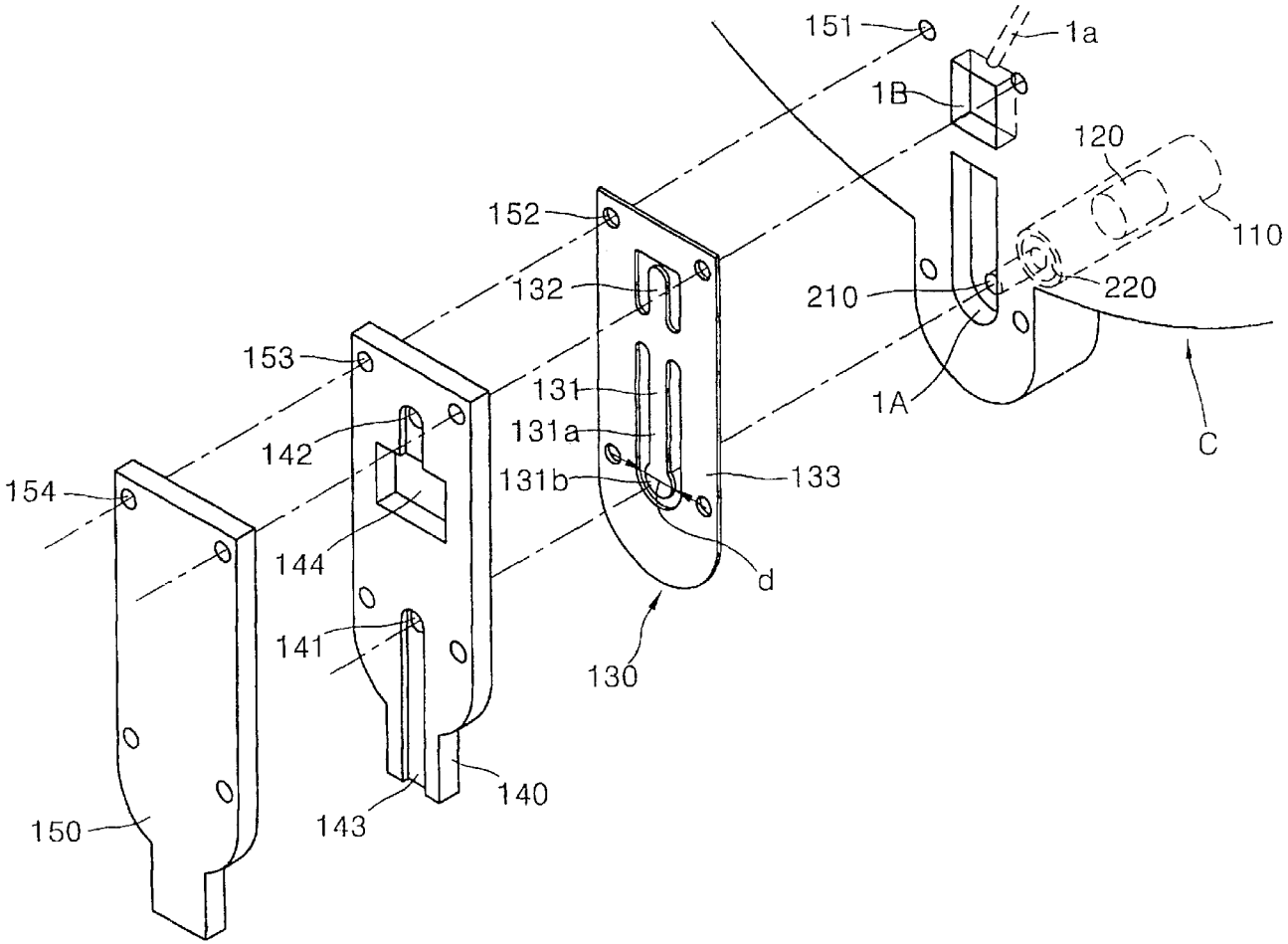
FIG. 4 is a disassembled-perspective view illustrating a lubricant supply apparatus of a reciprocating compressor in accordance with a first embodiment of the present invention.

A first embodiment of a lubricant supply apparatus for a reciprocating compressor in accordance with the present invention will now be described in greater detail hereinafter. As shown in FIGS. 3 and 4, a reciprocating compressor having a lubricant supply apparatus in accordance with the present invention includes a compressing unit C transversely installed inside a casing V filled with lubricant at the bottom. The compressing unit C is provided for compressing and discharging a refrigerant after drawing in the refrigerant through a suction side. A lubricant supply apparatus O is fixed to the exterior of the compressing unit C and is provided for supplying lubricant.

The lubricant supply apparatus O includes a lubricant cylinder 110 installed at the bottom surface of a frame 1 supporting the compressing unit C. A lubricant piston 120 is slidably inserted into the lubricant cylinder 110 and induces a pressure change inside the lubricant cylinder 110 in response to the oscillation or linear reciprocating motion of the compressing unit C. A rectangular lubricant valve 130 having a lubricant suction valve 131 and a lubricant discharge valve 132 is fixed to the front surface of the frame 1 and opens and shuts alternately according to a pressure variation of the lubricant cylinder 110.

A passage member 140 having a plate body corresponding to the lubricant valve 130, a suction port 141 and a discharge port 142 formed at the plate body, a lubricant suction channel 143 extending from the suction port 141 and a lubricant discharge channel 144 extending from the discharge port 142, and a valve cover 150 covering and supporting the lubricant valve 130 and the lubricant member 140 are also provided in the lubricant supply apparatus.

A suction valve movable region 1A connected to the suction port 141 of the valve cover 150 is formed at the front surface of the frame 1. A discharge valve movable region 1B connected to the discharge port 142 of the valve cover 140 is formed at the upper portion of the suction valve movable region 1A. A cross wall 1C is formed between the suction valve movable region 1A and the discharge valve movable region 1B in order to divide the regions. Accordingly, lubricant drawn into the compressing unit C and lubricant to be discharged can be divided and a reverse flow of discharge lubricant can be prevented.

Compression-type coil springs 160A, 160B are placed inside the lubricant cylinder 110 in order to elastically support both ends of the lubricant piston 120. A cylinder cover 110*a* having a through hole 110*b* is installed at the end of the lubricant cylinder 110 for facilitating a smooth flow of lubricant.

The lubricant piston 120 is formed in a cylindrical shape, and the outer circumference of the lubricant piston 120 is in contact with the inner circumference of the lubricant cylinder 110 when it is slidably-inserted into the lubricant cylinder 110. A main body of a lubricant valve 130 is a rectangular plate having a certain thickness. A lubricant suction valve 131 and a lubricant discharge valve 132 are separately punched and formed at the upper portion and lower portion centering around the middle portion of the main body.

The lubricant suction valve 131 is constructed with an elastic supporting portion 131*a* having a narrow width and a covering portion 131*b* having a round plate shape connected to the elastic supporting portion 131*a*. The lubricant suction valve 131 is formed by being separated from the main body of the lubricant valve 130. A diameter of the covering portion 131*b* is formed so as to be larger than a diameter of the suction port 141 formed at the passage member 140 in order to control a flow of lubricant passing through the suction port 141.

In addition, a lubricant opening 130*a* is formed at both sides of the lubricant suction valve 131 between the main body of the lubricant valve 130 and the lubricant suction valve 131. Lubricant flows when the suction valve movable region 1A of the frame 1 is connected to the discharge port 142 of the passage member 140.

Combining the passage member 140 and the lubricant valve 130, the elastic supporting portion 131*a* of the lubricant valve 130 is placed onto the lubricant discharge channel 144. The lubricant discharge valve 132 is punched and formed on the main body of the lubricant valve 130 to have a rectangular shape and has a width d capable of sufficiently shutting the discharge port 142 formed at the passage member 140.

The circular discharge port 142 and the circular suction port 141 are separately formed at the upper and lower portions of the passage member 140. The lubricant discharge channel 144 is formed to contact the discharge port 142 and to be grooved in a vertical direction. The lubricant suction channel 143 contacts with the suction port 141 so as to be grooved in a vertical direction. The lubricant discharge channel 144 is placed onto the lubricant opening 130*a* formed between the lubricant suction valve 131 and the valve plate 133.

The valve cover 150 is formed having a rectangular shape corresponding to the shape of the passage member 140. The valve cover 150 supports the lubricant valve 130 and the passage member 140. In addition, the valve cover 150, the passage member 140 and the lubricant valve 130 are combined with the frame 1 by fastening a plurality of combining holes 152, 153, 154 (punched on the outer circumference of each member, respectively) to a fastening hole 151 punched on the front surface of the frame 1 with an appropriate fastening member.

Figure 5:
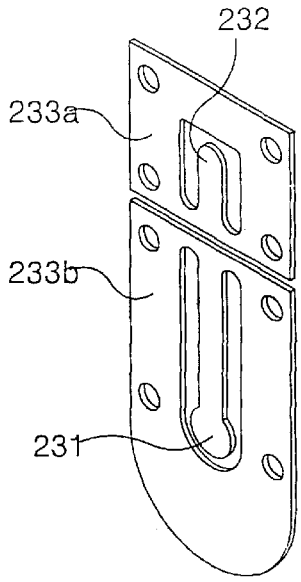
FIG. 5 is a perspective view illustrating another embodiment of a lubricant valve in accordance with the first embodiment of the present invention.

In another embodiment of the lubricant valve 130 in accordance with the first embodiment of the present invention as depicted in FIG. 5, the valve plate 133 itself is constructed with a upper valve plate 233*a* and a lower valve plate 233*b*. The lubricant discharge valve 232 is formed at the upper valve plate 233*a*, and the lubricant suction valve 231 is formed at the lower valve plate 233*b*.

Figure 6:
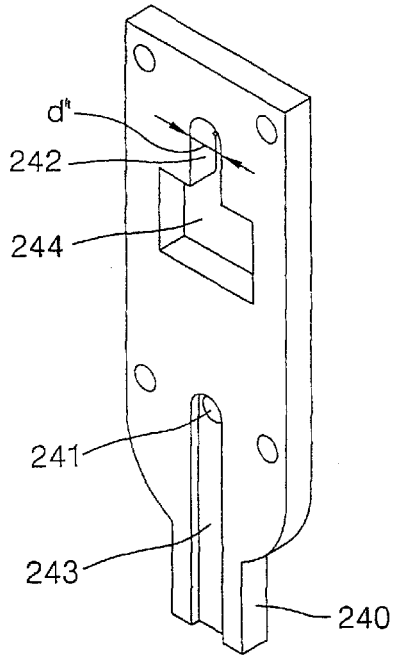
FIG. 6 is a perspective view illustrating another embodiment of a lubricant discharge channel formed at a passage member in accordance with the first embodiment of the present invention.

In another embodiment of a lubricant member 240 in accordance with the first embodiment of the present invention as depicted in FIG. 6, a lubricant discharge channel 244 is wholly connected to an upper discharge port 242 and penetrates the passage member 240.

A width d' of the discharge port 242 penetrating the passage member 240 is smaller than a width d of the lubricant discharge valve 132. The length is shorter than a length of the lubricant discharge valve 132.

Figure 7:
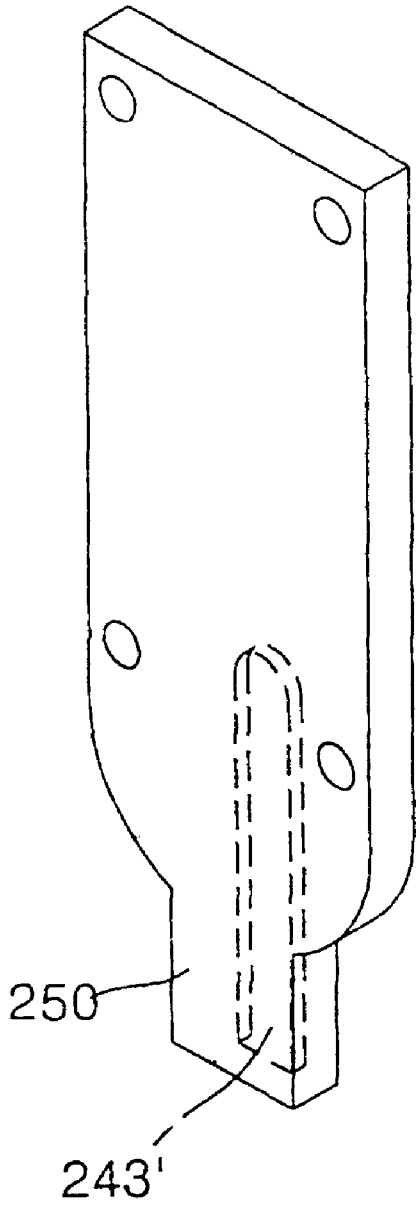
FIG. 7 is a perspective view illustrating another embodiment of a valve cover in accordance with the first embodiment of the present invention.

In another embodiment of a valve cover 250 in accordance with the first embodiment of the present invention as depicted in FIG. 7, the lubricant suction channel 143 is formed at the valve cover 150 by being grooved by being formed at the lower portion of the passage member 140.

Unexplained reference numeral 1 is a frame, 1*a* is a lubricant suction channel, 3 is a cylinder, 4 is an inner and outer stators, 5 is a magnetic assembly, 6 is a piston, 7 is a suction valve, 8 is a discharge valve assembly and 9 is a suction pipe.

The operation of the lubricant supply apparatus for a reciprocating compressor in accordance with the present invention will now be described in greater detail hereinafter. When the frame supporting the compressing unit C oscillates in a horizontal direction, the lubricant cylinder 110 formed at the frame 1 also oscillates in a horizontal direction. A pressure difference occurs when the lubricant piston 120 inserted into the lubricant cylinder 110 has an inertia force opposite to the reciprocating movement of the lubricant cylinder 110. Lubricant filled in a casing V is sucked or discharged in accordance with the respective pressure difference.

Figure 11A:
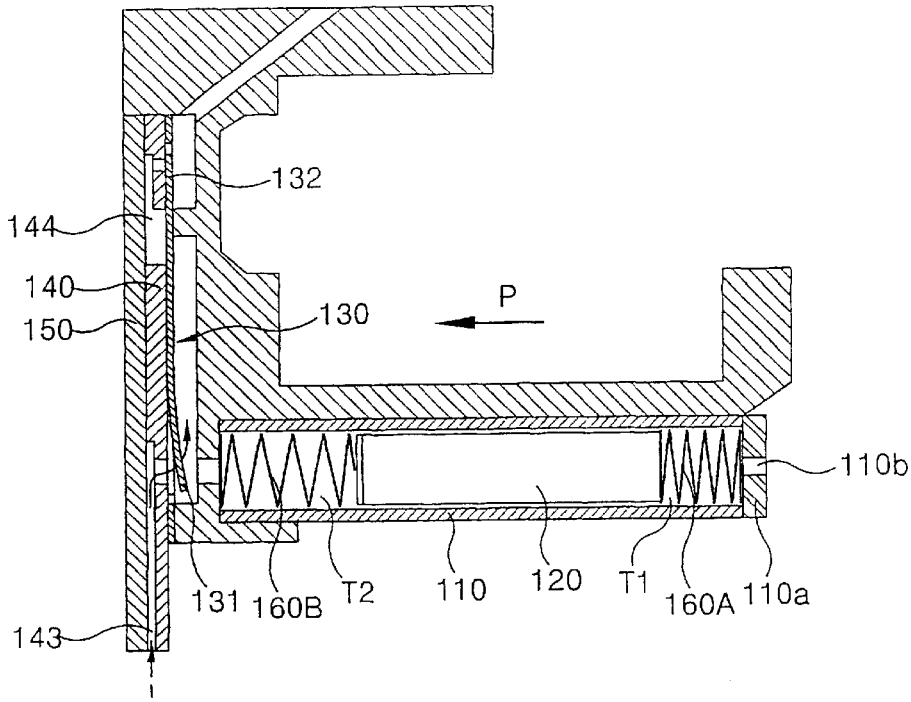
FIG. 11A is a longitudinal sectional view illustrating the operation of the lubricant supply apparatus of the reciprocating compressor in accordance with the present invention.

As depicted in FIG. 11A, when the lubricant cylinder 110 moves in a "P" direction, the lubricant piston 120 moves in a direction opposite to the direction of the lubricant cylinder 110, and an inward space T2 of the lubricant cylinder 110 is in a relatively low pressure state.

The suction port 141 of the passage member 140 is open when the cover portion 131*b* of the lubricant suction valve 131 of the lubricant valve 130 is pushed by a pressure of lubricant. Lubricant is sucked through the open suction port 141 and fills the suction valve movable region 1A of the frame 1 and the lubricant cylinder 110.

Figure 11B:
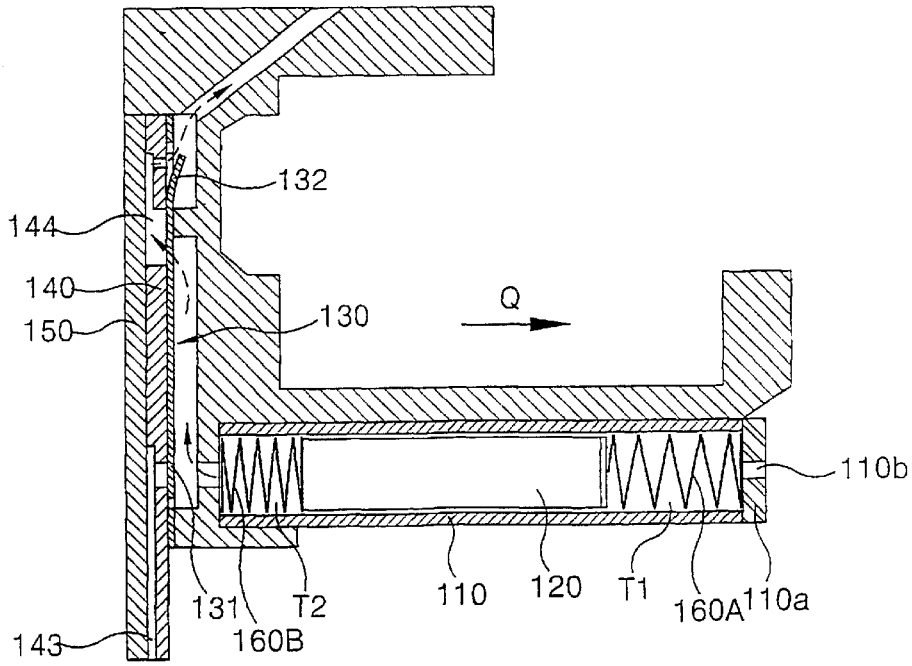
FIG. 11B is a longitudinal sectional view illustrating the operation of the lubricant supply apparatus of the reciprocating compressor in accordance with the present invention.

As depicted in FIG. 11B, when the lubricant cylinder 110 moves in a "Q" direction, the lubricant piston 120 moves in a direction opposite to the direction of the lubricant cylinder 110, and the inward space T2 of the lubricant cylinder is in a relatively high pressure state.

At this time, lubricant in the lubricant cylinder 110 and the suction valve movable region 1A of the frame 1 pushes the lubricant discharge valve 132 while moving to the discharge port 142 of the passage member 140 through the lubricant opening 130*a*. The lubricant discharge valve 132 is opened, and lubricant in the discharge port 142 is supplied to each part of the compressing unit C according to the lubricant suction channel 1*a*. At the same time, the cover portion 131*b* of the lubricant suction valve 131 of the lubricant valve 130 shuts the suction port 141 by being pushed by a high pressure occurring in the lubricant cylinder 110. Accordingly, the suction of lubricant is shut off.

As described above, the suction valve and the discharge valve are formed as a plate-shaped lubricant valve. The lubricant valve is installed at the side of the frame on the inward portion of a lubricant cylinder having a lower diameter. Accordingly, the present invention is advantageous for the fastening and assembling of each part.

Figure 8:
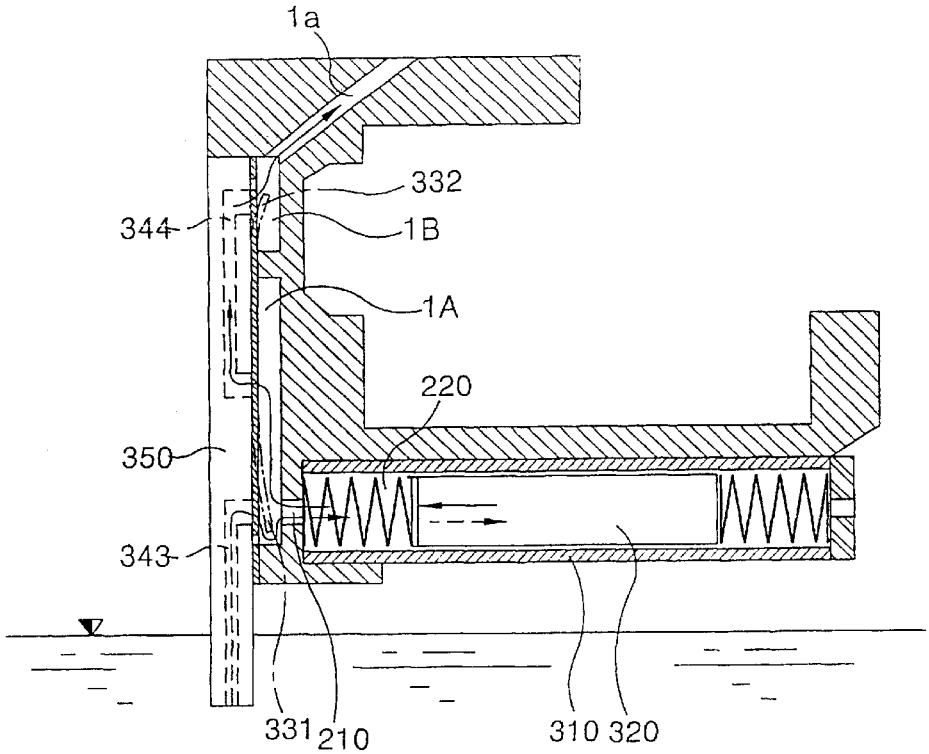
FIG. 8 is a partial sectional view illustrating a lubricant supply apparatus of a reciprocating compressor in accordance with a second embodiment of the present invention.

A second embodiment of a lubricant supply apparatus for a reciprocating compressor in accordance with the present invention will be described in greater detail hereinafter. As depicted in FIG. 8, a connection passage is included in the lubricant supply apparatus. The connection passage has an end connected to the inward space 220 of the lubricant cylinder 310 and its other end is connected to the lubricant suction channel 343 and the lubricant discharge channel 344.

The second embodiment of the lubricant supply apparatus of the reciprocating compressor includes a suction valve movable region 1A connected to the connection passage 210, a discharge valve movable region 1B connected to the lubricant suction passage 1*a*, a lubricant suction valve 331 and a lubricant discharge valve 332 placed at the valve movable region, and a valve cover 350 having a lubricant suction channel 343 and a lubricant discharge channel 344. The lubricant suction channel 343 and the lubricant discharge channel 343 can be constructed as an additional member.

Figure 9:
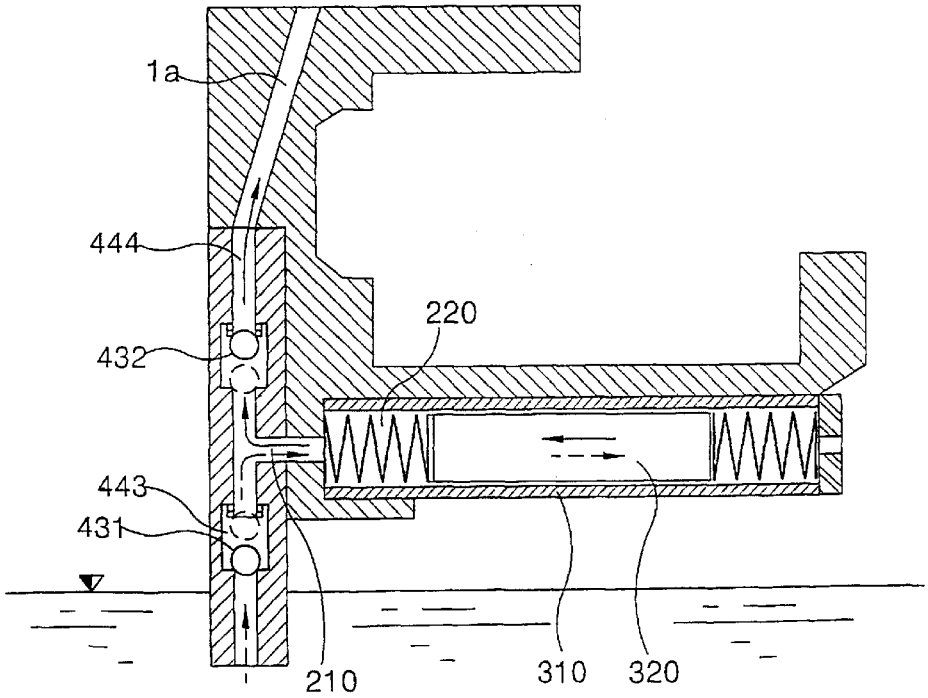
FIG. 9 is a partial sectional view illustrating another embodiment of a lubricant supply apparatus of a reciprocating compressor in accordance with the second embodiment of the present invention.

FIG. 9 illustrates another embodiment of a lubricant supply apparatus for a reciprocating compressor in accordance with the second embodiment of the present invention. A lubricant suction valve 431 and a lubricant discharge valve 432 are separately placed onto a lubricant suction channel 443 and a lubricant discharge channel 444 and are open and shut selectively.

As described above, since the connection passage 210 jointly controls suction and discharge of lubricant, it is advantageous to install the lubricant suction valve and the lubricant discharge valve at the exterior of the lubricant cylinder 310.

Figure 10:
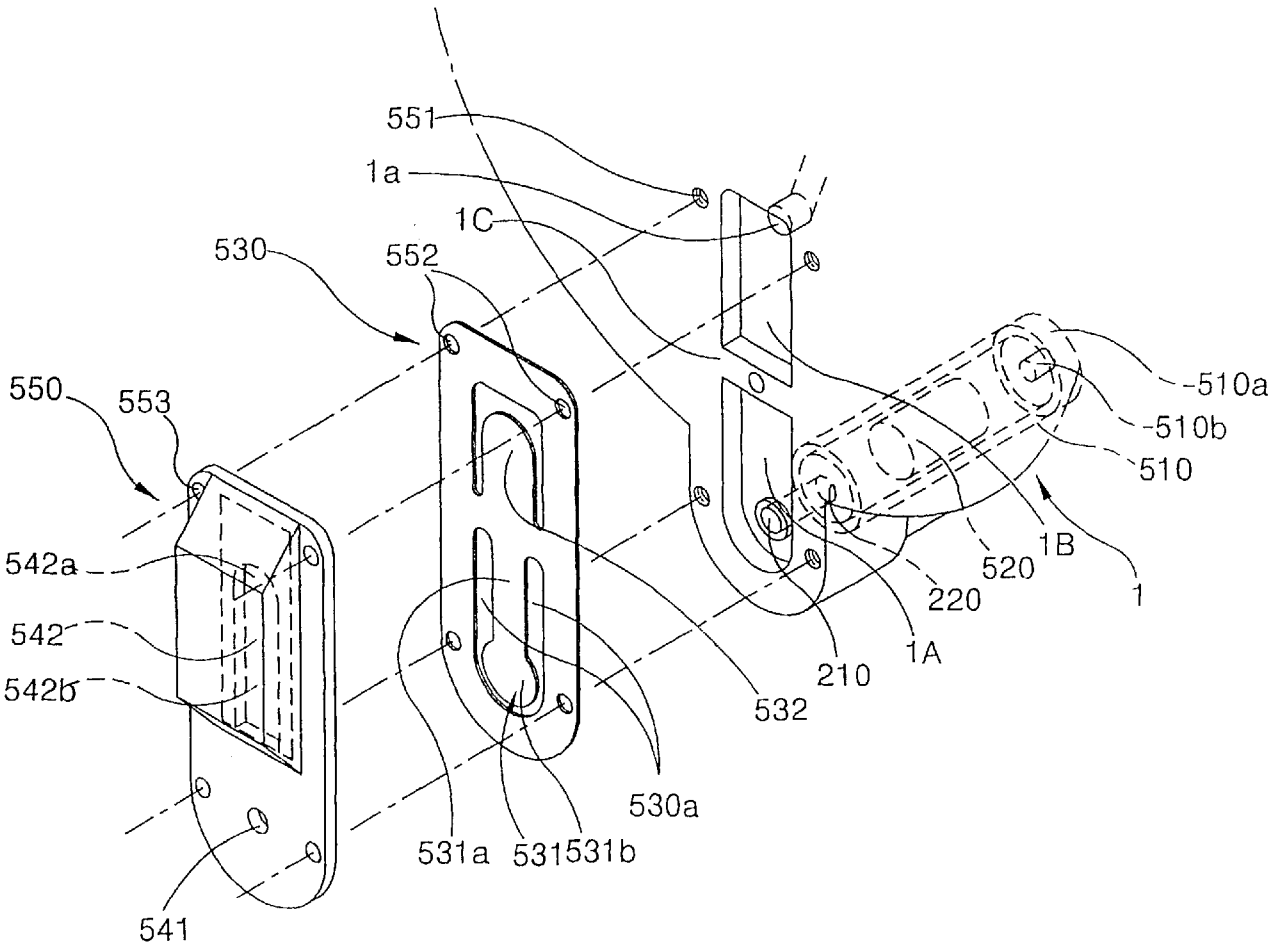
FIG. 10 is a longitudinal sectional view illustrating a lubricant supply apparatus of a reciprocating compressor in accordance with a third embodiment of the present invention.

Hereinafter, a third embodiment of the lubricant supply apparatus for the reciprocating compressor in accordance with the present invention will be described hereinafter. As depicted in FIG. 10, the lubricant supply apparatus O includes a lubricant cylinder 510 installed at the bottom surface of the frame 1 supporting the compressing unit C. A lubricant piston 520 is slidably inserted into the lubricant cylinder 510 and generates a pressure difference inside the lubricant cylinder 510 based on the oscillation of the compressing unit C. A lubricant valve 530 fixed to the front surface of the frame 1 and having a lubricant suction valve 531 and a lubricant discharge valve 532 are open and shut in accordance with the pressure difference of the lubricant cylinder 510. A valve cover 550 fixed to the front surface of the frame 1 by covering the lubricant valve 530 and having a suction port 541 and a discharge port 542 is also provided.

The suction valve movable region 1A connected to the suction port 541 of the valve cover 550 is formed on an inward portion of the frame 1. Above the suction valve movable region 1A and the discharge valve movable region 1B connected to the discharge port 542 of the valve cover 540 is formed inward portion of the frame 1. A cross wall 1C is formed between the suction valve movable region 1A and the discharge valve movable region 1B in order to divide them. Accordingly lubricant to be drawn in and lubricant to be discharged by the compressing unit C can be divided without being mixed. A reverse flow of discharged lubricant can also be prevented.

Compression-type coil springs 160A, 160B are included at inner ends of the lubricant cylinder 510 in order to support both ends of the lubricant piston 520. A cylinder cover 510*a* having a through hole 510*b* is formed at the end of the lubricant cylinder 510 for the smooth flow of lubricant. The lubricant piston 520 is formed having a cylindrical shape, and the outer circumference of the lubricant piston 520 is in contact with the inner circumference of the lubricant cylinder 110 when it is slidably-inserted into the lubricant cylinder 110.

A main body of a lubricant valve 530 is a rectangular plate having a certain thickness, a lubricant suction valve 531 and a lubricant discharge valve 532 are separately punched and formed at the upper portion and lower portion centering around the middle portion of the main body.

The lubricant suction valve 531 is constructed with an elastic supporting portion 531*a* having a narrow width and a covering portion 531*b* having a round plate shape connected to the elastic supporting portion 531*a*. The lubricant suction valve 531 is formed by being punched on the main body of the lubricant valve 530. A diameter of the covering portion 531*b* is formed so as to be larger than a diameter of the suction port 541 formed at the valve cover 550 in order to control the flow of lubricant passing through the suction port 541.

In addition, a lubricant opening 530*a* is formed at both sides of the lubricant suction valve 531 between the main body of the lubricant valve 530 and the lubricant suction valve 531 in order to make lubricant flow when the suction valve movable region 1A of the frame 1 is connected to the discharge port 542 of the valve cover 540.

The lubricant discharge valve 532 is punched and formed on the main body of the lubricant valve 530 so as to have a rectangular shape and a length and a width capable of sufficiently shutting the upper portion 542*a* of the discharge port 542 formed at the valve cover 540. The lower portion 542*b* of the discharge port 542 is placed on the lubricant opening 530*a* formed between the lubricant suction valve 531 and the valve main body.

In the valve cover 540, a circular suction port 541 is formed at the lower center portion so as to have a diameter smaller than a diameter of the covering portion 531*b* of the lubricant suction valve 531. A discharge port 542 is formed protruding from the center upper portion so as to have a long, grooved shape. The long, grooved shape has a certain volume, and a width and a length smaller than the lubricant discharge valve 532 of the lubricant valve 530.

In addition, the valve cover 550 and the lubricant valve 530 are combined to the frame 1 by fastening a plurality of fastening holes 552, 553 formed at the outer circumference to a plurality of fastening holes 551 formed at the front surface of the frame 1 with an appropriate fastening device.

The operation of the third embodiment of the lubricant supply apparatus of the reciprocating compressor is same as the first embodiment of the lubricant supply apparatus of the reciprocating compressor.

INDUSTRIAL APPLICABILITY

Hereinafter, advantages of a first embodiment of a lubricant supply apparatus of a reciprocating compressor will be described hereinafter. Since a lubricant suction channel and a lubricant discharge channel are formed at one side centering around a lubricant piston, lubricant can be supplied without forming a lubricant passage at the lubricant piston. Accordingly, miniaturization of a lubricant supply apparatus and a reduction of the unit cost of production are achieved with the simplified structure and process of the present invention.

In addition, by placing the lubricant suction valve and the lubricant discharge valve at the exterior of the lubricant cylinder, the process and assembly of the lubricant suction valve and the lubricant discharge valve can be easier. Since a gap between the lubricant valve and the valve seat are relatively larger than the structure of the background art, impurities do not get caught within these elements. Since there is no elastic member inserted inside the lubricant cylinder, the lubricant valve does not interfered with the elastic member. Accordingly, reliability of the lubricant supply apparatus of the reciprocating compressor increases.

A suction valve and a discharge valve are constructed as a lubricant valve having a plate shape. The lubricant valve is assembled to the side surface of the frame instead of being assembled inside the lubricant cylinder having a small diameter. Accordingly, fabricating and assembling of each part is improved.

An effect of the third embodiment of the lubricant supply apparatus of the reciprocating compressor will be described hereinafter. By constructing a valve cover including a suction port open and shut by a lubricant suction valve of a lubricant valve and a discharge port open and shut by a lubricant discharge valve of the lubricant valve, the assembly can be simplified by reducing the number of parts. Accordingly, productivity increases by simplifying the process and assembly, and the reliability of the lubricant supply apparatus of the reciprocating compressor increases by stabilizing the movement of the lubricant valve.

What is claimed is:

1. A lubricant supply apparatus for a reciprocating compressor, comprising;

a hollow lubricant cylinder having an interior space;

a lubricant piston being slidably installed inside the lubricant cylinder a lubricant suction channel connected to the interior space of the lubricant cylinder to draw in lubricant stored in a lubrication storage container; and a lubricant discharge channel connected to the interior space of the lubricant cylinder to discharge lubricant; wherein the lubricant suction passage and the lubricant discharge passage are placed at a side of the lubricant cylinder centering around the lubricant piston.

2. The apparatus according to claim 1, further comprising:

a lubricant cylinder cover having a through hole connected to an exterior of the lubricant cylinder and installed at the other side of the lubricant cylinder.

3. The apparatus according to claim 1, further comprising:

an elastic member installed in at least one portion of the interior space of the lubricant cylinder formed by the lubricant cylinder and the lubricant piston.

4. The apparatus according to claim 1, further comprising:

a lubricant valve including a lubricant suction valve open during a suction process of the lubricant piston and a lubricant discharge valve open during a discharge process of the lubricant piston; and a valve cover covering and supporting the lubricant valve.

5. The apparatus according to claim 4, wherein the lubricant suction channel and the lubricant discharge channel are formed in the valve cover.

6. The apparatus according to claim 5, further comprising:

a suction valve movable region being formed at a side surface of the compressing unit, corresponding to the lubricant suction channel and the lubricant discharge channel formed at the valve cover, wherein the suction valve movable region is connected to the lubricant cylinder and at the same time a suction port of the valve cover is connected to a discharge port of the valve cover when the lubricant discharge valve of the lubricant valve is open, and a discharge valve movable region connected to a lubricant suction passage is formed isolated from the suction valve movable region.

7. The apparatus according to claim 4, the lubricant valve including the lubricant suction valve and the lubricant discharge valve as a single part.

8. The apparatus according to claim 7, wherein the lubricant suction valve and the lubricant discharge valve are punched into portions of the lubricant valve, and a lubricant opening connecting the lubricant cylinder and the discharge port of the valve cover is formed at the punched of the lubricant suction valve portion.

9. The apparatus according to claim 7, wherein the lubricant suction valve is placed on the lubricant suction channel and the lubricant discharge valve is placed on the lubricant discharge channel.

10. The apparatus according to claim 1, further comprising:

a suction valve movable region connected to the inward interior space of the lubricant cylinder for moving the lubricant suction valve of the lubricant valve;

a discharge valve movable region connected to the lubricant guide passage for moving the lubricant discharge valve;

the lubricant valve being operatively connected to the suction valve movable region and the discharge valve movable region;

a passage member having a surface contacting the lubricant valve and an opposite surface, a suction port and a discharge port penetrating the lubricant valve and the opposite surface, and a lubricant discharge channel connected to the discharge port and the suction valve movable region; and the valve cover for forming the lubricant discharge channel formed at the passage member in a pipe shape.

11. The apparatus according to claim 10, wherein the lubricant discharge channel of the passage member is connected to the suction valve movable region by overlapping a part of the lubricant suction valve of the lubricant valve with the suction valve movable region and by providing a width of the overlapped lubricant suction valve smaller than a width of the lubricant discharge channel.

12. The apparatus according to claim 10, wherein the lubricant suction channel is formed at one of the passage member and the valve cover so as to be connected to the suction port of the passage member.

13. The apparatus according to claim 10, wherein the discharge port and the lubricant discharge channel of the passage member are connected by a groove having a certain width and a length.

14. The apparatus according to claim 10, wherein the discharge port of the passage member extends to the lubricant discharge channel.

15. The apparatus according to claim 10, wherein the lubricant valve is formed with a valve plate having a certain size, and the lubricant suction valve is punched in one portion of the valve plate and the lubricant discharge valve is punched in the other portion of the valve plate so as to move freely according to a flow of lubricant.

16. The apparatus according to claim 15, wherein the lubricant suction valve and the lubricant discharge valve of the lubricant valve are formed in different valve plates.

17. The apparatus according to claim 1, further comprising a lubricant valve includes a lubricant suction valve and a lubricant discharge valve placed on the lubricant suction channel and the lubricant discharge channel.

18. The apparatus according to claim 17, wherein the lubricant suction valve and the lubricant discharge valve of the lubricant valve are formed as separate units.

19. The apparatus according to claim 17, wherein the lubricant suction valve and the lubricant discharge valve of the lubricant valve are formed as one unit.

20. A reciprocating compressor comprising:

a reciprocating motor having a reciprocating magnetic assembly positioned between an inner stator and an outer stator;

a compression unit having a cylinder and a lubricant guide passage guiding lubricant inside the cylinder; and a piston operatively connected to the magnetic assembly for compressing a refrigerant while sliding inside the cylinder; and a lubricant supply apparatus for the reciprocating compressor, including:

a hollow lubricant cylinder having an interior space;

a lubricant piston being slidably installed inside the lubricant cylinder;

a lubricant suction channel connected to the interior space of the lubricant cylinder to draw in lubricant stored in a lubrication storage container of the reciprocating compressor;

a lubricant discharge channel connected to the interior space of the lubricant cylinder to discharge lubricant; wherein the lubricant suction passage and the lubricant discharge passage are placed at a side of the lubricant cylinder centering around the lubricant piston.

21. A reciprocating compressor comprising:

a reciprocating motor having a reciprocating magnetic assembly positioned between an inner stator and an outer stator;

a compression unit having a cylinder and a lubricant guide passage guiding lubricant inside the cylinder; and a piston operatively connected to the magnetic assembly for compressing a refrigerant while sliding inside the cylinder; and a lubricant supply apparatus for the reciprocating compressor, including:

a hollow lubricant cylinder having an interior space;

a lubricant piston placed inside the lubricant cylinder and being capable of sliding within said cylinder;

a lubricant suction channel connected to the interior space of the lubricant cylinder to draw in lubricant stored in a lubricant storage container of the reciprocating compressor;

a lubricant discharge channel connected to the interior space of the lubricant cylinder to discharge lubricant;

a lubricant valve unit having a lubricant suction valve and a discharge valve, a lubricant suction passage and a lubricant discharge passage and a valve cover; wherein the lubricant suction passage and the lubricant discharge passage are placed at a side of the lubricant cylinder centering around the lubricant piston, and the lubricant valve unit is placed at the exterior of the lubricant cylinder.

22. A reciprocating compressor comprising:

a reciprocating motor having a reciprocating magnetic assembly positioned between an inner stator and an outer stator;

a compression unit having a cylinder and a lubricant guide passage guiding lubricant inside the cylinder; and a piston operatively connected to the magnetic assembly for compressing a refrigerant while sliding inside the cylinder; and a lubricant supply apparatus for the reciprocating compressor, including:

a hollow lubricant cylinder having an interior space;

a lubricant piston placed inside the lubricant cylinder and being capable of sliding within said lubricant cylinder;

a lubricant suction channel connected to the interior space of the lubricant cylinder to draw in lubricant stored in a lubricant storage container;

a lubricant discharge channel connected to the interior space of the lubricant cylinder so as to discharge lubricant;

a lubricant valve unit having a lubricant suction valve and a discharge valve, a lubricant suction passage and a lubricant discharge passage and a valve cover; wherein the lubricant valve unit is placed on the exterior of the lubricant cylinder.

* * * * *